United States Patent [19]

Chiba et al.

[11] 4,418,729

[45] Dec. 6, 1983

[54] SHUTTLELESS LOOM WEFT DETAINING DEVICE

[75] Inventors: Yoshiharu Chiba; Hidetsugu Umezawa; Takao Sakabe; Ryuji Arai, all of Mitaka, Japan

[73] Assignee: Nissan Motor Co., Ltd., Yokohama, Japan

[21] Appl. No.: 326,568

[22] Filed: Dec. 2, 1981

[30] Foreign Application Priority Data

Dec. 11, 1980 [JP] Japan ..... 55-173748

[51] Int. Cl.[3] ..... D03D 47/36

[52] U.S. Cl. ..... 139/452; 242/47.01

[58] Field of Search ..... 139/452; 242/47.01, 242/47.12, 47.13; 66/132

[56] References Cited

U.S. PATENT DOCUMENTS 3,370,618 2/1968 Svaty et al. ..... 139/452
3,761,031 9/1973 Pfarrwaller ..... 139/452

FOREIGN PATENT DOCUMENTS 24561 3/1981 European Pat. Off. .
1911735 6/1970 Fed. Rep. of Germany .
1929485 12/1970 Fed. Rep. of Germany .
1760738 1/1972 Fed. Rep. of Germany .
1478294 4/1967 France .
1547158 11/1968 France .

*Primary Examiner*—Henry Jaudon
*Attorney, Agent, or Firm*—Thompson, Birch, Gauthier & Samuels

[57] ABSTRACT

A shuttleless loom weft detaining device comprises a drum around which a weft yarn is wound prior to its introduction to a weft inserting nozzle, the drum including a frustoconical section, a cylindrical section integral with the frustoconical section, a projecting section radially and outwardly projecting over the radial level of the cylindrical section, and a connecting section integral with the projecting section to connect the radial top level of the projecting section with the radial level of the cylindrical section and located to leave the cylindrical section between it and the frustoconical section, and apparatus for catching the weft yarn in association with the drum peripheral surface to detain a predetermined length of the weft yarn prior to a weft picking through the weft inserting nozzle, thereby maintaining generally constant the drawing-off resistance of the weft yarn from the drum every weft picking.

13 Claims, 6 Drawing Figures

SHUTTLELESS LOOM WEFT DETAINING DEVICE

BACKGROUND OF THE INVENTION

1. Field of the Invention

This invention relates to an improvement in a weft detaining device for detaining a predetermined length of a weft yarn prior to weft picking by weft inserting means.

2. Description of the Prior Art

In connection with a shuttleless loom, a spun yarn which is lower in tensile strength has come into use particularly in air jet type shuttleless looms. Accordingly, it is desirable to control the weft yarn tension because a slight variation in tension breaks the weft yarn. Some conventional devices detain or store the weft yarn in a length of about $\frac{2}{3}$ of that required for each weft picking. The weft yarn tension abruptly increases when the yarn is changed from its free flight period, in which the detained weft yarn is picked, to the measuring flight period, in which the weft picking continues measuring the length of the weft yarn. Therefore, it is necessary to detain the weft yarn in a length required for each weft picking in order to draw off the weft yarn from the detaining device with lower resistance. This has been achieved, for example, by a known device arranged as follows: A ring having an annular brush is disposed around an end section at the weft inserting nozzle side of a drum having a conical section and a cylindrical section. This drum functions to wind the weft yarn thereon in the length required for each weft picking. The length of detained weft yarn is maintained constant by optically sensing the amount on the drum and rotating the drum accordingly. In this device, the annular brush serves as a stop for the weft yarn at the end section at the weft inserting nozzle side, and functions to prevent the weft yarn wound on the drum from coming off.

With such a device, since more weft yarn than is required for each weft picking remains on the drum, the weft picking is accomplished with the weft yarn which is completely detained on the drum and therefore an abrupt variation in weft yarn tension does not occur during weft picking. However, the weft yarn always receives resistance to its movement since it is drawn off from the drum, contacting with the annular brush. This results in the following disadvantages, particularly in a shuttleless loom whose weft picking is accomplished by a relatively weak pulling force, for example in the air jet type shuttleless loom: (1) weft yarn shortpicks may occur in the warp yarn shed; (2) higher air pressure is required to overcome the weft yarn dragging force; and (3) the detaining device cannot select the weft yarn in the amount required for each weft picking and accordingly requires a device for restricting the length of the weft yarn to be picked.

BRIEF SUMMARY OF THE INVENTION

According to the present invention, a weft detaining device of a shuttleless loom comprises a drum around which a weft yarn is wound prior to its introduction to a weft inserting nozzle. The drum is provided with a frustoconical section tapered generally toward the weft inserting nozzle, a cylindrical section integral with the frustoconical section, a projecting section which is radially and outwardly projecting over the radial level of the cylindrical section, the projecting section being spaced from the frustoconical section in the axial direction of the drum, and a connecting section integral with the projecting section to connect the radial top level of the projecting section with the radial level of the cylindrical section, the connecting section being located to leave the cylindrical section between it and the frustoconical section. The weft detaining device is so arranged as to catch the weft yarn in association with the drum peripheral surface to detain a predetermined length of the weft yarn on the drum peripheral surface prior to a weft picking through the weft inserting nozzle. With the thus arranged weft detaining device, the weft yarn can be detained generally at the same location on the drum peripheral surface every operational cycle of the loom, thereby maintaining generally constant the drawing-off resistance of the weft yarn from the weft detaining device every weft picking. This results in effective and stable weft pickings, overcoming the drawbacks encountered in prior art weft detaining devices.

BRIEF DESCRIPTION OF THE DRAWINGS

The features and advantages of the weft detaining device according to the present invention will be more clearly appreciated from the following description taken in conjunction with the accompanying drawings in which like reference numerals designate like parts and elements, and in which.

DETAILED DESCRIPTION OF THE EMBODIMENTS OF THE INVENTION

Figure 1:
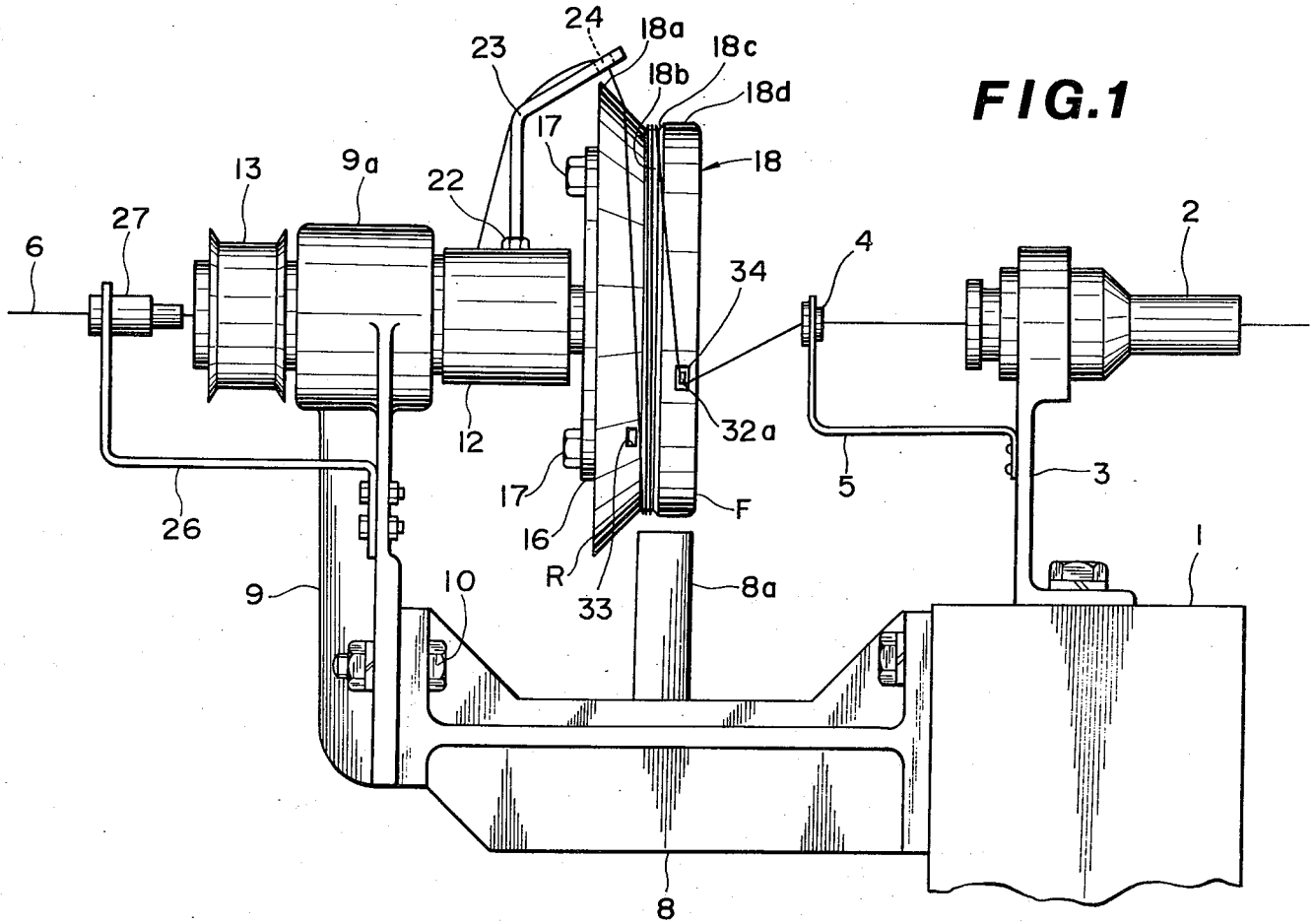
FIG. 1 is a front elevation of an essential part of a shuttleless loom equipped with a preferred embodiment of a weft detaining device according to the present invention.

Referring now to FIGS. 1 to 4 of the drawings, there is shown a preferred embodiment of a weft detaining device of a shuttleless loom, in accordance with the present invention. The shuttleless loom comprises a weft inserting air injection nozzle 2 which is supported by a nozzle holder 3 which is fixed on a frame 1 of the shuttleless loom. A weft guide 4 is supported by a stay 5 which is secured to the nozzle holder 3, and located rearward of the nozzle 2 so that the axis thereof is in alignment with that of the nozzle 2. Accordingly, a weft yarn 6 from the weft detaining device discussed hereinafter is introduced into the nozzle 2 through the weft guide 4, and is then picked or inserted into a warp shed (not shown) by means of air injected from the nozzle.

A bracket 9 having a bearing section 9*a* is secured to the frame 1 of the shuttleless loom through a horizontally disposed bracket 8 which is directly secured to the frame of the loom by bolts 7, as shown in FIG. 1. The bracket 9 is connected at its bottom part to the bracket 8 with bolts 10 and nuts so that the axis of the bearing section 9*a* is in alignment with that of the weft guide 4.

Figure 2:
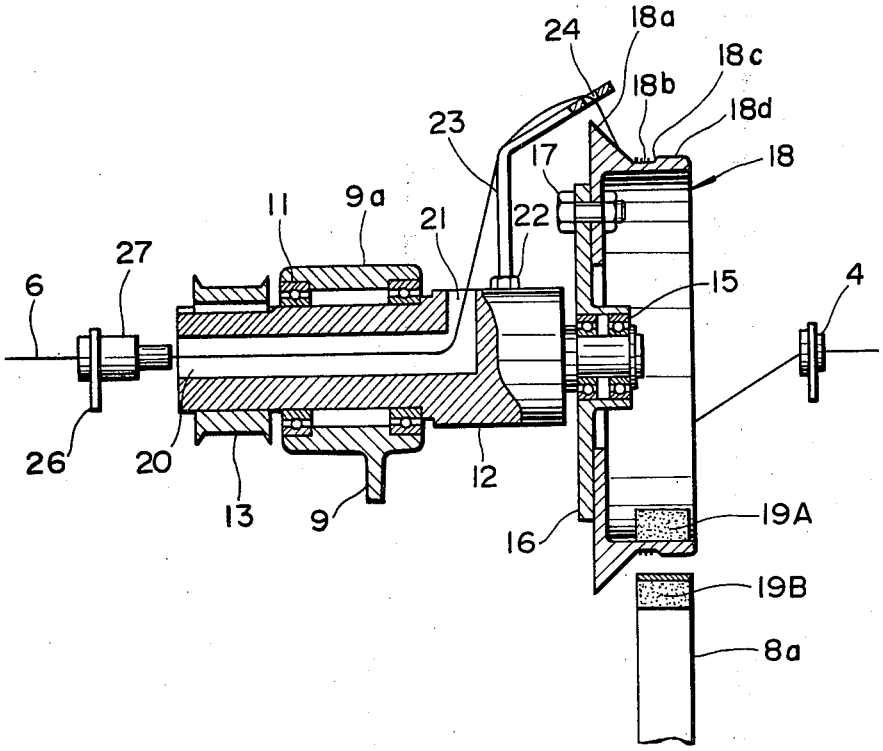
FIG. 2 is a vertical sectional view of the weft detaining device of FIG. 1.

As clearly shown in FIG. 2, a shaft 12 is rotatably supported at its central section within the bearing section 9a by a ball bearings 11. A toothed pulley 13 is fixedly mounted on a rear section of the rotatable shaft 12. A toothed belt (not shown) is provided to connect the pulley 13 and a drive pulley (not shown) to rotate the rotatable shaft 12 in timed relation to the operational cycle of the loom. In this instance, the rotatable shaft 12 rotates four times per each operational cycle of the loom.

Figure 4:
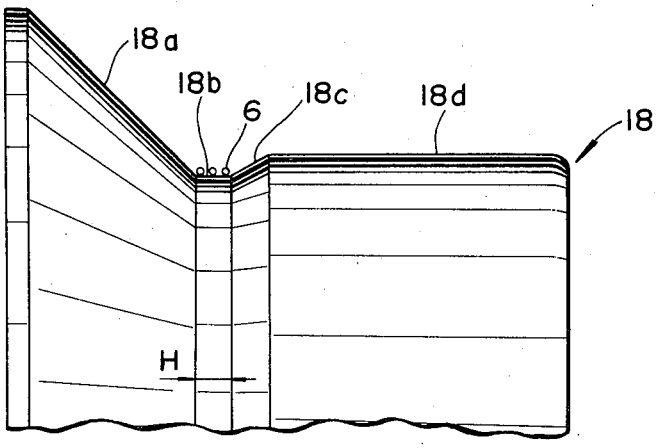
FIG. 4 is an enlarged fragmentary front view of a drum of the weft detaining device of FIG. 1.

A support member 16 is rotatably mounted through ball bearings 15 on a front section of the rotatable shaft 12 so as to be rotatable relative to the shaft 12. A drum 18 forming part of the weft detaining device is fixedly supported by the support member 16 by means of bolts 17. Additionally, a magnet 19A is securely disposed at a position of the inside surface of the drum 18. This magnet 19A is opposite to a magnet 19B securely supported at the tip section of a support 8a mounted on the bracket 8, which magnet 19A is located outside of the drum 18. As shown, the magnet 19B is spaced apart from the outer peripheral surface of the drum 18, but a magnetic attraction is generated between the two magnets 19A, 19B so that the drum 18 is maintained at a stationary state regardless of the rotation of the rotatable shaft 12. The drum 18 is formed with an outer peripheral surface which comprises a wider frustoconical section 18a connecting to the rear end R of the drum and whose diameter gradually decreases toward the weft inserting nozzle 2, i.e. in the direction from the rear end R toward the front end F of the drum 18. A smaller-diameter cylindrical section 18b of the drum outer peripheral surface integrally connects at one end thereof with the frustoconical section 18a at the smallest diameter part. The diameter of the cylindrical section 18b is so set that the length of the weft yarn 6 wound four times around the cylindrical section 18b corresponds to the weft yarn length required for each pick. The smaller-diameter cylindrical section 18b is formed to have a relatively small width H as indicated in FIG. 4. A narrower frustoconical section 18c of the drum outer peripheral surface is connected at its smallest diameter part with the other end of the smaller-diameter cylindrical section 18b. The narrower frustoconical section 18c gradually increases in its diameter toward the weft inserting nozzle 2, i.e. in the direction from the rear end R to the front end F of the drum 18. Additionally, a larger-diameter cylindrical section 18d of the drum outer peripheral surface is larger in diameter than the smaller-diameter cylindrical section 18b and is integrally connected at its one end with the largest diameter part of the narrower frustoconical section 18c.

The rotatable shaft 12 is formed along the axis thereof with an elongate weft introduction hole 20 which opens to the rear end of the rotatable shaft 12. Additionally, a weft drawing-out hole 21 is formed connecting with the weft introduction hole 20 and opening to the peripheral surface of the rotatable shaft 12. Securely attached on the peripheral surface of the rotatable shaft 12 by means of a lock nut 22 is a weft winding-guide member 23 by which the weft yarn 6 is guided onto the frustoconical section 18a of the drum 18. The weft winding guide member 23 is bent to approach the surface of the frustoconical section 18a of the drum 18 and is formed at its free end section with a weft guide opening 24 through which the weft yarn 6 passes. Accordingly, the weft yarn 6 drawn from a weft supply source or bobbin (not shown) is introduced into the weft introduction hole 20 and the weft drawing-out hole 21 after being passed through an air injection nozzle 27 for weft yarn introduction. The nozzle 27 is supported by a stay 26 fixed onto the bracket 9 and is located rearward of the rotatable shaft 12 so that the axes of the nozzle 27 and the shaft 12 are aligned with each other. Subsequently, after being introduced along the winding guide member 23 and being passed through the opening 24, the weft yarn 6 is wound around the wider frustoconical section 18a and the smaller-diameter cylindrical section 18b of the drum 18, on which the weft yarn 6 is caught by at least one of hook levers 31 and 32 which will be discussed hereinafter. Then, the weft yarn 6 is passed through the weft guide 4.

Figure 3:
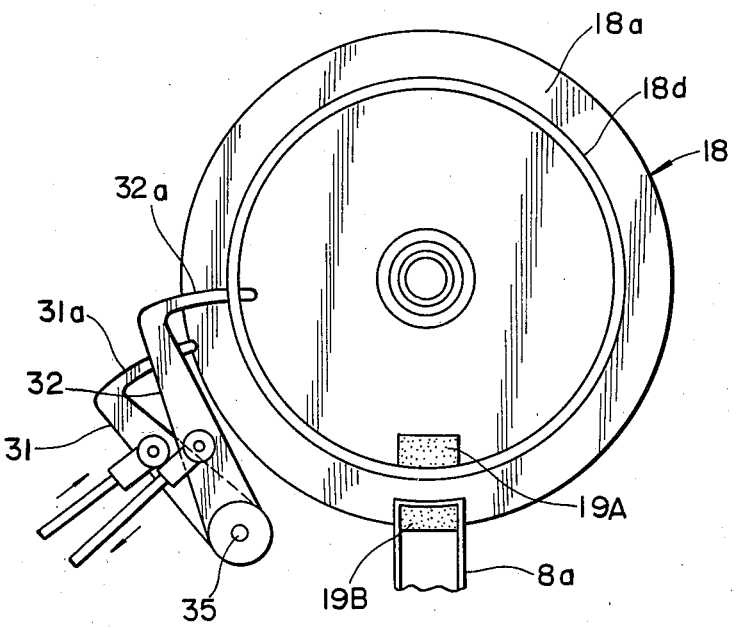
FIG. 3 is a side elevation of the weft detaining device of FIG. 1.

As shown in FIG. 3, the hook levers 31 and 32 are pivotally and rotatably mounted on a fixed shaft 35 and are formed at their end sections with hook sections 31a and 32a, respectively. The hook sections 31a and 32a are located to be able to be inserted respectively into holes 33 and 34 which are respectively located on the frustoconical section 18a in the vicinity of the border with the cylindrical section 18b and on the cylindrical section 18d. In this instance, the holes 33 and 34 pass through or pierce the wall of the drum 18. The hook levers 31, 32 are so arranged as to be swingable clockwise and that their hook sections 31a, 32a are inserted into or withdrawn from the holes 33, 34 at predetermined timings, respectively, in the operational cycle of the loom. It is to be noted that the hole 34 is formed appreciably forward of the hole 33 in the direction at which the weft yarn 6 is wound around the drum, i.e. rearward of the hole 33 in the direction at which the weft yarn 6 is drawn off on the drum. In this connection, the hook section 32a of the hook lever 32 is arranged to project to a position which is appreciably forward relative to a position where the hook section 31a of the hook lever 31 projects, in the direction at which the weft yarn 6 is wound around the drum.

The manner of operation of the weft detaining device will be discussed thereinafter.

During operation of the loom, the rotatable shaft 12 rotates four times per each operational cycle of the loom; however the drum 18 cannot rotate and is maintained in a stationary state by virtue of the magnetic attraction generated between the magnets 19A, 19B. Accordingly, with the rotation of the rotatable shaft 12, the weft winding guide member 23 rotates around the periphery of the drum 18, so that the weft yarn 6 is wound around the wider frustoconical section 18a of the drum 18. Then, the weft yarn 6 on the wider frustoconical section 18a slides along the slope of wider frustoconical section 18a by the tension thereof and moves to the smaller-diameter cylindrical section 18b, pushing forward the wound weft yarn located in front thereof.

When the operational cycle of the loom reaches a time immediately before the weft picking, the hook sections 31a and 32a of the hook levers 31 and 32 are respectively inserted into the holes 33 and 34 of the drum 18. In this state, the weft yarn 6 is caught by the hook section 31a of the hook lever 31 and thereafter is caught by the hook section 32a of the hook lever 32 after being wound four times around the cylindrical section 18b. With the advance of the operational cycle of the loom from this state, when the hook section 32a of the hook lever 32 withdraws from the hole 34 of the drum 18, the restriction to the weft yarn 6 is removed, so that the weft yarn is picked by the air injection of the weft inserting nozzle 2 which air injection starts immediately before the withdrawal of the hook section 32*a*. When the amount of the wound weft yarn on the cylindrical section 18*b* becomes nothing or zero by this weft picking, the weft yarn 6 is caught by the hook section 31*a* of the hook lever 31, by which the weft picking is completed. Since the weft winding-guide member 23 is rotating during this weft picking, the weft yarn 6 continues to be wound around the wider frustoconical section (18*a*) side relative to the hook section 31*a* of the hook lever 31.

At the closing period of the beating-up step, the weft yarn 6 is wound approximately two times around the frustoconical section 18*a*. Then, the hook section 32*a* of the hook lever 32 is again inserted into the hole 34 of the drum 18. Subsequently, the hook section 31*a* of the hook lever 31 is withdrawn from the hole 33 of the drum 18. As a result, the weft yarn 6 which has been caught by the hook section 31*a* slides down along the slope of the frustoconical section 18*a* and moves onto the smaller-diameter cylindrical section 18*b* to be caught by the hook section 32*a*.

At this stage, when the catching action to the weft yarn 6 is taken over from the hook section 31*a* to the hook section 32*a*, it is possible to draw out from the drum 18 the weft yarn 6 in a length corresponding to the distance between the hook sections 31*a* and 32*a* since the hook section 32*a* is located rearward relative to the hook section 31*a* in the direction where the weft yarn 6 is drawn off. Therefore, during the beating-up operation in which the picked weft yarn is beaten up against a cloth felt of a woven fabric (not shown), the weft yarn 6 on the drum 18 is suitably drawn off due to a weft yarn tension rise by an advancing movement of the reed. This relaxes the tension rise of the weft yarn 6 during the beating-up operation, thereby preventing the weft yarn from being cut. Then, when the weft yarn 6 is wound approximately four times around the cylindrical section 18*b*, the hook section 31*a* of the hook lever 31 is projected into and between the weft yarn sections respectively wound around the wider frustoconical and smaller-diameter cylindrical sections 18*a* and 18*b* to separate them each other. Immediately thereafter, the weft picking is carried out as discussed above.

Now, the behavior of the weft yarn 6 wound around the drum 18 will be considered. It will be understood that the weft yarn wound around the wider frustoconical section 18*a* slides down along the slope of the frustoconical section 18*a* to gradually move to the smaller-diameter cylindrical section 18*b*. However, the weft yarn does not slide down in the vicinity of the hook section 31*a* in the state where the weft yarn is caught by the hook section 31*a* of the hook lever 31. As described above, when the catching of the weft yarn 6 is taken over from the hook section 31*a* by the hook section 32*a*, the weft yarn 6 wound around the frustoconical section 18*a* slides down onto the smaller-diameter cylindrical section 18*b*. At this moment, the tension of the weft yarn 6 momentarily decreases and therefore the weft yarn 6 tends to roll over toward the narrow frustoconical section (18*c*) side or the wider frustoconical section (18*a*) side by the rolling-over force of the weft yarn 6 due to the applied twist or the cancelled twist caused during the rolling-down of the weft yarn 6 along the slope of the wider frustoconical section 18*a*. However, the weft yarn 6 can be prevented from such rolling-over movement because the weft yarn is stably kept on the smaller-diameter cylindrical section 18*b* which is located between the opposite slope surfaces of the wider and narrower frustoconical sections 18*a*, 18*c*. As a result, the weft yarn 6 is stably detained on the smaller-diameter cylindrical section 18*b*, which makes generally constant the drawing-off resistance of the weft yarn applied during the weft picking, thereby effectively achieving weft picking.

For reference, if the drum 18 is not provided with the smaller-diameter cylindrical section 18*b*, the weft yarn will be twisted during the rolling-over thereof along the slope of the frustoconical section 18*a*, which will cancel or increase the inherent twist of the weft yarn. Furthermore, such weft yarn twist applied by its rolling-over movement unavoidably varies depending on the kinds of yarns (the degree and the direction of the twist). Additionally, even in the same yarn, the twist varies depending on the parts of the yarn, so that the twist of the weft yarn is not constant throughout its overall length. Therefore, the weft yarn may irregularly move on the drum and is not detained on the same location on the drum. As a result, the drawing-off resistance of the weft yarn is lower in cases where the weft yarn is detained in the vicinity of the hook section 32*a* of the hook section 32, whereas the drawing-off resistance of the weft yarn is higher in cases where the weft yarn is detained in the vicinity of the hook section 31*a* of the hook lever 31. Thus, such different weft drawing-off resistances are disadvantageous for achieving effective weft pickings. Particularly, the higher drawing-off resistance results in shortpicks of the weft yarn. As will be appreciated from the above, the weft detaining device according to the present invention is very advantageous for achieving effective weft pickings.

Figure 5:
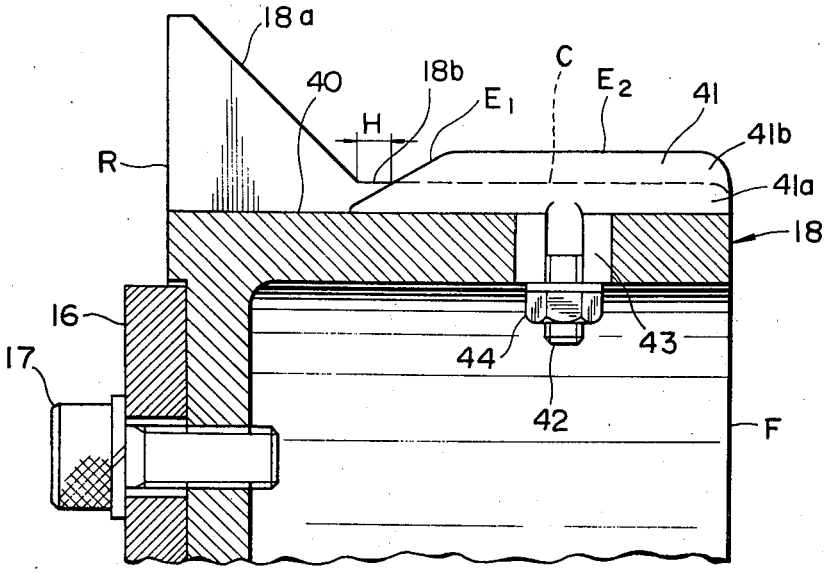
FIG. 5 is an enlarged fragmentary section of a drum of another embodiment of the weft detaining device according to the present invention.
Figure 6:
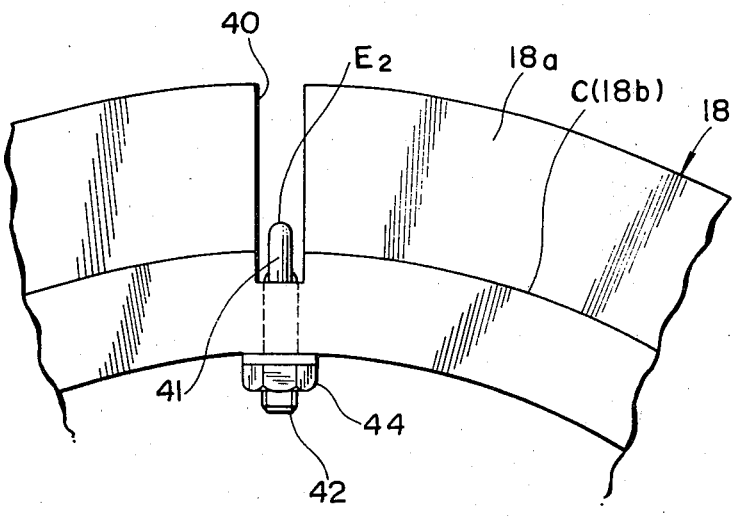
FIG. 6 is an enlarged fragmentary side view of the drum of FIG. 5.

FIGS. 5 and 6 illustrate another embodiment of the weft detaining device according to the present invention. In this embodiment, the drum 18 is formed with the frustoconical section 18*a*, and a cylindrical section C which is integral with the smallest diameter part of the frustoconical section 18*a*. The cylindrical section C extends in the axial direction of the drum to the front end face F thereof. The drum 18 is formed on its outer surface with a plurality of radially outward grooves 40 each of which extends in the axial direction of the drum 18. The grooves 40 are formed in parallel at suitable intervals along the periphery of the drum outer surface. As shown, each groove 40 extends from the front to rear end faces F, R of the drum 18.

A plate member 41 is disposed in each groove 40 in such a manner that its lower section 41*a* is located below the level of the peripheral surface of the cylindrical section C, and its upper section 41*b* is located over the peripheral surface level of the cylindrical section C. The upper section 41*b* is formed with an inclined edge portion $E_1$ which extends from a top edge portion $E_2$ and reaches the level of the peripheral surface of the cylindrical section C so as to define the narrower cylindrical section 18*b* of the width H on the cylindrical section C between the frustoconical section 18*a* and the inclined edge portion $E_1$ as viewed from the direction perpendicular to a vertical plane containing the axis of the drum, as shown in FIG. 5. It will be understood that the inclined edge portion $E_1$ and the top edge portion $E_2$ function the same as the narrower frustoconical section 18*c* and the larger-diameter cylindrical section 18*d* of the drum 18 in the embodiment of FIGS. 1 to 4.

The plate member 41 is integrally formed at its lower section with a stud-bolt 42 which is vertically disposed within an elongate hole 43 formed through the drum cylindrical wall at a section below the groove 40. The bolt 42 is secured in position by means of a nut 44. In this embodiment, it is possible to vary the width H of the narrower cylindrical section 18*b* by sliding the plate member 41 along the groove 40 and fixing it at a suitable position.

While only the stationary drum type weft detaining devices have been shown and described as the embodiments of the present invention, it will be understood that the principle of the present invention may be applied to weft detaining devices of the rotatable drum type wherein a weft yarn is guided by a stationary weft winding-guide member onto a rotating drum.

As can be appreciated from the above, according to the present invention, the detaining location of the weft yarn on the drum surface is always maintained generally constant and stable. This can keep the weft drawing-off resistance generally constant at every weft picking, thereby achieving effective weft pickings.

What is claimed is:

1. A weft detaining device of a shuttleless loom having a weft inserting means, comprising:

a drum around which a weft yarn is wound prior to its introduction to the weft inserting means, said drum including a first frustoconical section tapered generally toward the weft inserting means, a first cylindrical section integral with said frustoconical section at the smallest diameter part, a projecting section radially and outwardly projecting over the radial level of said first cylindrical section, said projecting section being spaced from said first frustoconical section in the axial direction of said drum, and a connecting section integral with said projecting section to connect the radial top level of said projecting section with the radial level of said cylindrical section, said connecting section being located to leave said first cylindrical section between it and said first frustoconical section; and means for catching the weft yarn in association with the peripheral surface of said drum to detain a predetermined length of the weft yarn on the drum peripheral surface prior to a weft picking through the weft inserting means.

2. A weft detaining device as claimed in claim 1, wherein said connecting section is a second frustoconical section which is integral with said first cylindrical section and smaller in width than said first frustoconical section, said second frustoconical section increasing in diameter in the direction away from said first cylindrical section, in which said projecting section is a second cylindrical section which is integral with said second frustoconical section at the largest diameter part and larger in diameter than said first cylindrical section.

3. A weft detaining device as claimed in claim 1, wherein said projecting section includes a plate member secured to said drum and extending in the axial direction of said drum, said plate member being formed with a top flat edge portion forming part of said projecting section, and an inclined edge portion forming part of said connecting section and reaching the radial level of said first cylindrical section.

4. A weft detaining device as claimed in claim 3, further comprising means defining a groove which extends in the axial direction of said drum, in which said plate member is disposed within said groove.

5. A weft detaining device as claimed in claim 4, wherein said plate member is movable in the axial direction of said drum.

6. A weft detaining device as claimed in claim 2, wherein said drum is substantially stationary and formed on its peripheral surface with first and second holes, said first hole being located farther from the weft inserting means than said second hole in the axial direction of said drum, said first hole being located in the vicinity of a border between said first frustoconical and cylindrical sections, said second hole being located on said second cylindrical section.

7. A weft detaining device as claimed in claim 6, wherein said catching means includes first and second hook levers located outside of said drum and formed respectively with first and second hook sections which are capable of projecting respectively into said first and second holes of said drum to catch the weft yarn on the drum peripheral surface so as to prevent the weft yarn from moving, a predetermined length of the weft yarn for each weft picking being detained between said projected first and second hook sections, said first and second hook sections being constructed and arranged to project respectively into the first and second holes of said drum at predetermined timings in timed relation to the operational cycle of the loom.

8. A weft detaining device as claimed in claim 1, further comprising a weft winding-guide member located near the peripheral surface of said drum and rotatable around the drum peripheral surface in timed relation to the operation cycle of the loom to guide the weft yarn to be wound around the peripheral surface of said drum.

9. A weft detaining device as claimed in claim 7, wherein said first hook section is constructed and arranged to project at least for a period of weft picking, and said second hook section is constructed and arranged to project for a period except for at least the weft picking period.

10. A weft detaining device as claimed in claim 8, further comprising a shaft rotatable in timed relation to the operational cycle of the loom, said weft winding-guide member being fixedly connected to said rotatable shaft so as to rotate with said rotatable shaft.

11. A weft detaining device as claimed in claim 10, wherein said drum is mounted on said rotatable shaft and is rotatable relative to said rotatable shaft, and further comprising means for maintaining said drum at a stationary state regardless of the rotation of said rotatable shaft.

12. A weft detaining device as claimed in claim 11, wherein said maintaining means includes a first magnet securely disposed inside of said drum, and a second magnet securely disposed outside of said drum to generate magnetic attraction between it and said first magnet.

13. A weft detaining device as claimed in claim 10, wherein said rotatable shaft is formed with an elongate hole along the axis thereof, said elongate hole opening to an end face and to the peripheral surface of said rotatable shaft, the weft yarn from a weft supply source being introduced into said elongate hole to be guided to said weft winding-guide member.

* * * * *